US009700135B2

(12) United States Patent
Herring et al.

(10) Patent No.: US 9,700,135 B2
(45) Date of Patent: Jul. 11, 2017

(54) ELECTRIC HEIGHT ADJUSTABLE DESK WITH SYNCHRONOUS MOVING MECHANICAL FOOTREST

(71) Applicant: Next Technologies, Inc., Georgetown, TX (US)

(72) Inventors: Jason Brian Herring, Georgetown, TX (US); Shane Michael Gilbreath, Georgetown, TX (US)

(73) Assignee: Spindle 360, Inc., Georgetown, TX (US)

( * ) Notice: Subject to any disclaimer, the term of this patent is extended or adjusted under 35 U.S.C. 154(b) by 112 days.

(21) Appl. No.: 14/788,487

(22) Filed: Jun. 30, 2015

(65) Prior Publication Data

US 2017/0000255 A1 Jan. 5, 2017

(51) Int. Cl.

| | |
|---|---|
| ***A47C 16/02*** | (2006.01) |
| ***A47B 9/00*** | (2006.01) |
| ***A47B 13/00*** | (2006.01) |
| ***A47B 21/02*** | (2006.01) |

(52) U.S. Cl.

CPC ..... *A47B 9/00* (2013.01); *A47B 13/00* (2013.01); *A47B 21/02* (2013.01); *A47C 16/02* (2013.01); *A47C 16/025* (2013.01); *A47B 2200/0097* (2013.01)

(58) Field of Classification Search

CPC ..... A47C 16/02; A47C 16/025

See application file for complete search history.

(56) References Cited

U.S. PATENT DOCUMENTS

| | | | | |
|---|---|---|---|---|
| 2,881,823 A * | 4/1959 | Abraham | ..... | A47C 16/025 297/423.42 |
| 3,554,600 A * | 1/1971 | Hennessey | ..... | A47C 16/025 297/423.42 |
| 3,653,715 A * | 4/1972 | Drabert | ..... | A47C 16/025 108/147.22 |

(Continued)

OTHER PUBLICATIONS

Pope et al., "Spine Ergonomics", Annual Review of Biomedical Engineering, vol. 4: 49-68.

(Continued)

*Primary Examiner* — Timothy J Brindley

(74) *Attorney, Agent, or Firm* — Kevin Keener; Keener and Associates P.C.

(57) ABSTRACT

An electric height adjustable desk with synchronous moving footrest, method of use, and a rotatable footrest assembly. The desk comprises: a desktop; two electric height adjustable desk leg members; two horizontal base members; and a rotatable footrest assembly. The rotatable footrest assembly comprises: two footrest frame members; two pivot spring connection units; and a rotatable footrest unit comprising a U-shaped foot bar member connected on each end to a pivot spring connection unit. Each spring connection unit comprises: a gas spring; a tension member; and both are connected to a pivot plate member. The tension member and the gas spring work together to rotate the footrest unit to a horizontal position while the desktop rises, and to a vertical position while the desktop is lowered. The tension member may further comprise an extension member to delay rotating the footrest unit until the desktop has reached a selected height.

18 Claims, 8 Drawing Sheets

(56) References Cited

U.S. PATENT DOCUMENTS

| | | | | | |
|---|---|---|---|---|---|
| 4,452,449 | A * | 6/1984 | Propst | A47C 3/026 | 482/41 |
| 4,714,025 | A * | 12/1987 | Wallin | A47B 9/00 | 108/147 |
| 5,041,770 | A | 8/1991 | Seiler et al. | | |
| 5,174,224 | A * | 12/1992 | Nagy | A47B 21/00 | 108/185 |
| 5,289,782 | A * | 3/1994 | Rizzi | A47B 9/02 | 108/146 |
| 5,323,695 | A | 6/1994 | Borgman et al. | | |
| 5,344,217 | A * | 9/1994 | McLaughlin | A47C 16/02 | 297/423.25 |
| 5,365,860 | A * | 11/1994 | Billington, III | A47C 9/025 | 108/108 |
| 5,439,074 | A * | 8/1995 | Trout | A01M 31/02 | 108/152 |
| 5,826,941 | A * | 10/1998 | Olsen | A47C 16/02 | 108/108 |
| 5,863,282 | A * | 1/1999 | Moossun | A47B 17/00 | 297/423.1 |
| 7,322,656 | B2 | 1/2008 | Wang | | |
| 7,908,978 | B1 * | 3/2011 | Pelton, Jr. | A47B 21/03 | 108/50.01 |
| D649,369 | S * | 11/2011 | Benden | D6/338 | |
| 8,291,833 | B2 | 10/2012 | Skiba | | |
| 2010/0288168 | A1 * | 11/2010 | Rheault | A47B 13/10 | 108/28 |
| 2012/0112035 | A1 * | 5/2012 | Volke | A47C 16/025 | 248/571 |
| 2012/0125237 | A1 * | 5/2012 | Heyvaerts | A47B 9/08 | 108/50.14 |
| 2014/0020606 | A1 | 1/2014 | Benden | | |
| 2014/0312754 | A1 * | 10/2014 | Hecht | A47B 9/04 | 312/309 |

OTHER PUBLICATIONS

Pronk et al., "Reducing Occupational Sitting Time and Improving Worker Health: The Take-a-Stand Project, 2011", Prey Chronic Dis 2012, vol. 9, Oct. 11, 2012.

Halim et al, "A Review on Health Effects Associated with Prolonged Standing in the Industrial Workplaces", IJRRAS; Jul. 2011: 8(1): 14-21.

E.g. Sartika et al, "Investigation of Lower Limb Fatigue on Two Standing Posture", Jumal Optimasi Sistem Industri, Apr. 2012: 11(1): 208-213.

Pope et al.,"Spine Ergonomics", Annual Review of Biomedical Engineering, Aug. 2002; vol. 4: 49-68; Abstract.

Pronk et al., "Reducing Occupational Sitting Time and Improving Worker Health: The Take-a-Stand Project, 2011", Prev Chronic Dis 2012, vol. 9, Oct. 11, 2012.

Sartika et al, "Investigation of Lower Limb Fatigue on Two Standing Posture", Jurnal Optimasi Sistem Industri, Apr. 2012: 11(1): 208-213.

* cited by examiner

ELECTRIC HEIGHT ADJUSTABLE DESK WITH SYNCHRONOUS MOVING MECHANICAL FOOTREST

FIELD OF THE DISCLOSURE

The field of the disclosure is that of office desks. More specifically, the field is height adjustable desks with footrests that adjust simultaneously when a desk moves between a sitting and standing position.

BACKGROUND OF THE DISCLOSURE

The adverse effects of prolonged sitting are well documented. Prolonged sitting can cause: an accumulation of metabolites; accelerated disk degeneration leading to disk herniation; premature mortality; chronic diseases such as cardiovascular disease, diabetes, and cancer; and obesity (Pope et al., "Spine Ergonomics", Annual Review of Biomedical Engineering, Vol. 4: 49-68; and, Pronk et al., "Reducing Occupational Sitting Time and Improving Worker Health: The Take-a-Stand Project, 2011", Prey Chronic Dis 2012, Vol. 9, Oct. 11, 2012).

Height adjustable desks that position a user to stand and work have become popular to assist a user in avoiding these adverse health effects. But prolonged standing also has its drawbacks: back, feet, and leg muscle fatigue leading to injury; chronic venous insufficiency and varicose veins; carotid atherosclerosis; preterm birth; and, joint compression and tearing where the synovial fluid is not circulating and thus reducing the normal lubrication and cushioning of synovial joints, such as knees (e.g. Halim et al, "A Review on Health Effects Associated with Prolonged Standing in the Industrial Workplaces", IJRRAS; July 2011: 8(1): 14-21).

A user therefore needs to be able to rapidly shift between sitting and standing at their desk throughout the course of their workday in order to avoid these adverse effects while maximizing the benefits of standing. Height adjustable desks are specifically designed for this purpose. Via a user controlled electrical or mechanical mechanism linked to the desk, the desktop will quickly rise to a standing position and lower to a sitting position so as not to interrupt the user's work.

Footrests for use with height adjustable desks also help to alleviate the adverse effects of prolonged standing. The purpose of the footrest is to provide proper biomechanical support of the spine and hips while the user is standing. By raising one leg slightly, the pressure on the lower lumbar discs shifts to the outer pelvis, thus reducing spinal compression leading to disc degeneration. Footrests also provide relief to a user experiencing muscle fatigue in their back, feet and legs from prolonged standing (e.g. Sartika et al, "Investigation of Lower Limb Fatigue on Two Standing Posture", Jurnal Optimasi Sistem Industri, April 2012: 11(1): 208-213).

Height adjustable desks with unattached footrests are known in the art. For example, a user may purchase a height adjustable desk and a footrest separately, but these footrests require the user to physically move and store the footrest when it is not in use. Additionally, these unattached footrests are normally too high to provide the proper alignment of the spine when the user is standing, which requires raising one leg only a few inches and shifting the user's weight outwardly (i.e. right-left).

A few height adjustable desks with built-in footrests are also known in the art, but the footrests are often: too high in elevation for proper spinal alignment when the user is standing; they do not move automatedly with the desktop movements; and, they obstruct the user's legs when sitting because the footrest is stored in a low position near the front of the desk.

What is needed within the industry of height adjustable desks is a footrest that automatedly shifts from a sitting to a standing position when the desktop is raised and lowered. Footrest adjustment between a standing and sitting position should not require any physical work and time from the user. Additionally, the footrest should not obstruct the user's legs when they are sitting at the desk. And, the footrest should also be appropriate for use with a standing position by being positioned only a few inches off of the ground for the proper biomechanical support of the user's spine, versus footrests for sitting that are the approximate height of the chair to elevate and straighten a user's legs (e.g. see U.S. Pat. No. 7,322,656 issued to Wang). And lastly, the footrest should be hidden from view when not in use.

SUMMARY OF THE DISCLOSURE

In providing a solution to the foregoing and other known problems and disadvantages inherent in the related art of height adjustable desks with footrests, the present disclosure involves: 1) an electric height adjustable desk with a synchronous moving non-electric footrest assembly; 2) its method of use; and, 3) a footrest assembly for use with a variety of types of height adjustable desks. The footrest assembly while in a standing position is elevated only a few inches from the ground to properly support the user's spinal alignment; and while in the sitting position, it is hidden from view and completely removed from blocking the user's leg room beneath the desk because it resides above and/or in front of the user's knees.

In one embodiment, the height adjustable desk is under the operational control of electric motor(s) attached to and/or within the desk, and further comprises: a horizontal desktop; a plurality of height adjustable desk leg members (e.g. two legs) powered by one or more electric motors; two horizontal base members, one each affixed to the bottom of a leg member to stabilize them; and a rotatable footrest assembly that is not powered by an electric motor. In one or more exemplified embodiments disclosed herein, the electric motor comprises one motor each housed within a desk leg member.

The desk may further comprise a horizontal crossbar member extending between and connecting the two desk leg members. The crossbar further stabilizes the desk legs and prevents the footrest assembly from over rotating towards the front of the desk. It also shields from view the footrest assembly went it is in a vertical sitting position.

One or more embodiments of the present disclosure further comprise an exemplified automated height adjustable desk with a synchronous moving footrest assembly, comprising: a) a horizontal desktop adjustable between a sitting and a standing position; b) two or more vertical, electric height adjustable desk leg members supporting the desktop; c) two or more flat plate base members, each attached horizontally beneath and to a desk leg member; and, d) a footrest assembly.

The footrest assembly of the present disclosure is a mechanical structure that resides entirely beneath the desktop and out-of-view from the front of the desk when the footrest is in a vertical position. The footrest assembly comprises a rotatable footrest unit (e.g. foot resting bar) that extends horizontally between the desk leg members. The footrest assembly automatedly swings or rotates in an arc from a vertical position between the leg members when the user is sitting, to a horizontal position when the desktop is raised for the user to stand and work and rest their right and/or left foot. The user is not required to exert any force to move the footrest assembly because its mechanism of movement between a vertical and horizontal position is linked to the vertical movement of the desktop.

Each footrest assembly further comprises: a) two footrest frame members, each one vertically aligned with one height adjustable desk leg member, and connected to a rotatable footrest unit; b) a rotatable footrest unit comprising a foot bar member with two opposing ends, such as one that is U-shaped, and with each end connected to a pivot spring connection unit; and c) two pivot spring connection units, each one positioned between the footrest frame member and the desk leg member, and able to rotate the footrest unit between a vertical position when the desktop is in a sitting position and a horizontal position when the desktop is in a standing position.

Furthermore, each of the two pivot spring connection units comprise: 1) a gas spring; 2) a tension member (e.g. a tension spring and/or an elastic band), with or without an extension member; and, 3) a pivot plate unit, wherein both (1) and (2) are connected to the pivot plate unit. The tension member and the gas spring work in unison to rotate the footrest unit to a horizontal position when the desktop is raised, and to a vertical position when the desktop is lowered.

The tension member may further comprise an extension member to delay rotating the footrest unit until the desktop has reached a designated height. Each extension member (e.g. link, hook, etc.) is connected between the top end of the tension member and the desktop, such as at the desktop underside. The longer the extension member, the higher the desktop rises before the footrest unit rotates downward.

The footrest bar member is subjected to a weight from the user's feet and shifting movements, and may thus be susceptible to bending. To prevent this, the tension member may further comprise one or more (e.g. two) footrest stabilizer members, such as small vertical bar members (e.g. 2-5 inches in height) affixed to the underside of the footrest bar member to keep it in a horizontal position and off of the ground when lowered. Each footrest stabilizer member may also rest upon a flat plate base member beneath the desk leg member when the desk is in a standing position.

The footrest assembly of the present disclosure may also be used in conjunction with other height adjustable desks, such as those that are manually raised and lowered, and/or other electric height adjustable desks than the exemplified embodiments disclosed herein. The footrest assembly is not required in these embodiments to be vertically aligned with and in near contact with the desktop leg members. Instead, each footrest assembly may comprise two footrest frame members to encase (e.g. four total with one on each side) the rotatable footrest unit and the pivot spring connection unit, or other structures to stabilize the footrest assembly.

And a method of use of an embodiment of the electric height adjustable desk disclosed herein comprises the user activating the electric switch, such as a power control mechanism located on the desktop, to raise the desktop from a lower sitting position, to an elevated standing position. As the desktop rises, the footrest assembly simultaneously pivots (e.g. swings or rotates in an arc) a footrest unit from a vertical stored position between and/or aligned with the desktop legs and desk crossbar member, to a horizontal position with the footrest unit easily reachable while a user is standing at the desk. Then when the user wishes to sit down again, s/he activates the electric switch to lower the desktop, and the footrest assembly will automatically pivot the footrest unit back to its stored vertical position simultaneously while the desktop is lowering.

BRIEF DESCRIPTION OF THE DRAWINGS

Other characteristics and advantages will emerge more clearly on reading the following description of various embodiments of the present disclosure, given as an illustrative example, and the appended figures wherein "right" and "left" side of the desk are from the perspective of the user behind the desk.

DETAILED DESCRIPTION OF ILLUSTRATIVE EMBODIMENTS

Figure 1:
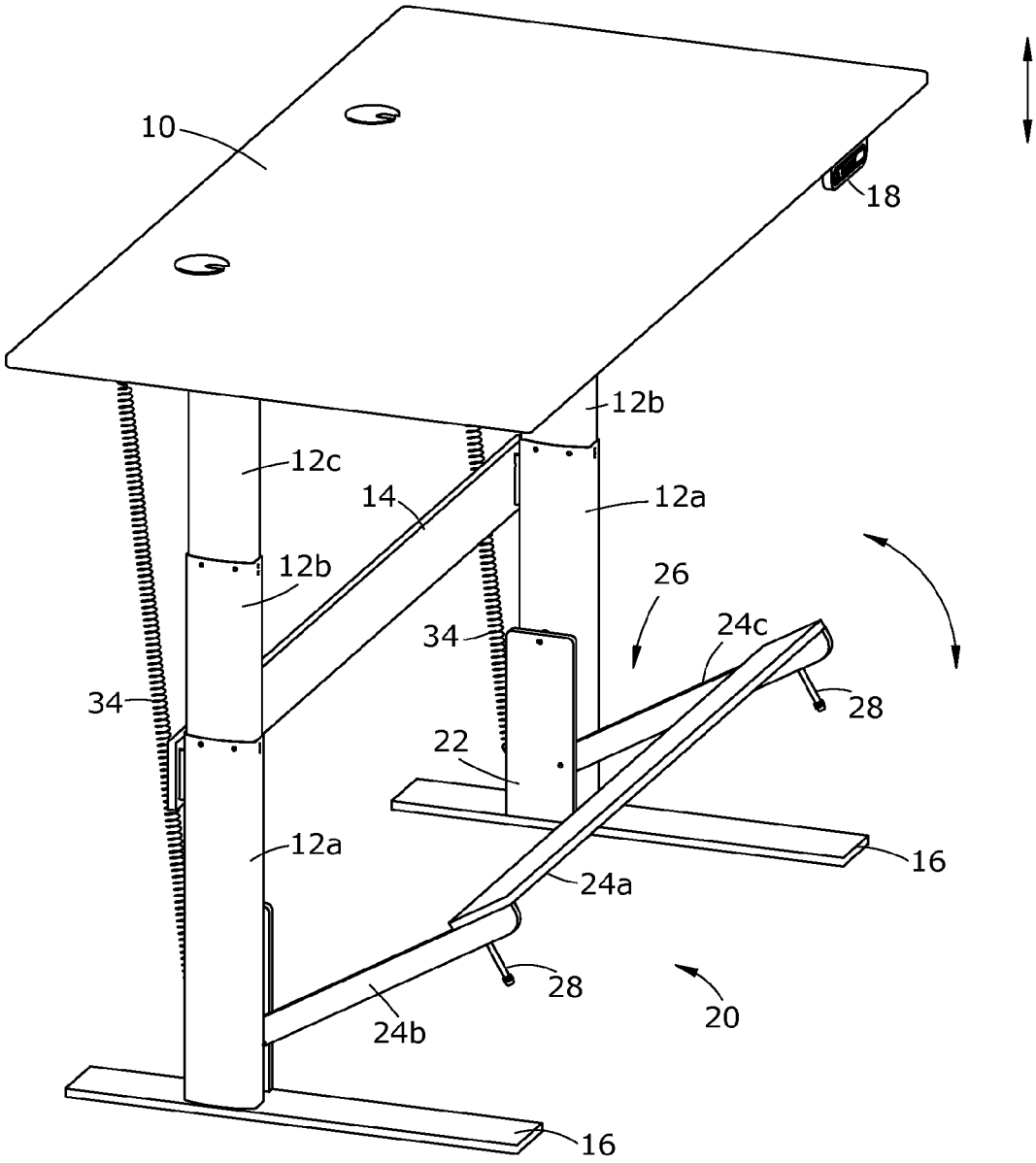
FIG. 1 is a left top perspective view of the desk in a position where the footrest unit is in the process of being lowered while the desktop is simultaneously being raised.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined in the description, such as detailed construction and elements, are provided to assist in a comprehensive understanding of the present general inventive concept. Thus, it is apparent that the exemplary embodiments may be carried out without those specifically defined matters. Also, well-known functions or constructions are not described in detail since they would obscure the exemplary embodiments with unnecessary detail.

Electric Height Adjustable Desk Assembly

The electric height adjustable desk assembly exemplified in FIGS. 1-8 comprises a footrest assembly 20 connected to a two legged electric height adjustable office desk comprising: a horizontal desktop 10; two parallel height adjustable desk leg members 12 supporting the desktop 10; two flat plate base members 16 attached horizontally beneath (i.e. to the bottom end of) the desk leg members 12; an optional horizontal crossbar member 14 connecting the two leg members 12; and, a power switch 18 on the desktop 10 to activate and in-activate the electric motors, or actuators, that raise and lower the desktop 10.

In one or more embodiments, the electric motor comprises a dual 18-volt direct current motor housed within each desk leg member 12, such as the motor used in the Next-Desk™ height adjustable desk. It is noted height adjustable desks are well known in the art, and that one of skill in the art could readily arrange for other electric height adjustable desks to be substituted for the exemplified desk for use with the present footrest assembly 20 in which the desktop is raised and lowered under the operational control of a power source within the desk leg members and/or attached to the desk. Therefore, it is envisioned that the presently disclosed footrest assembly can be used with a wide variety of types of two and four legged height adjustable desks.

Figure 2:
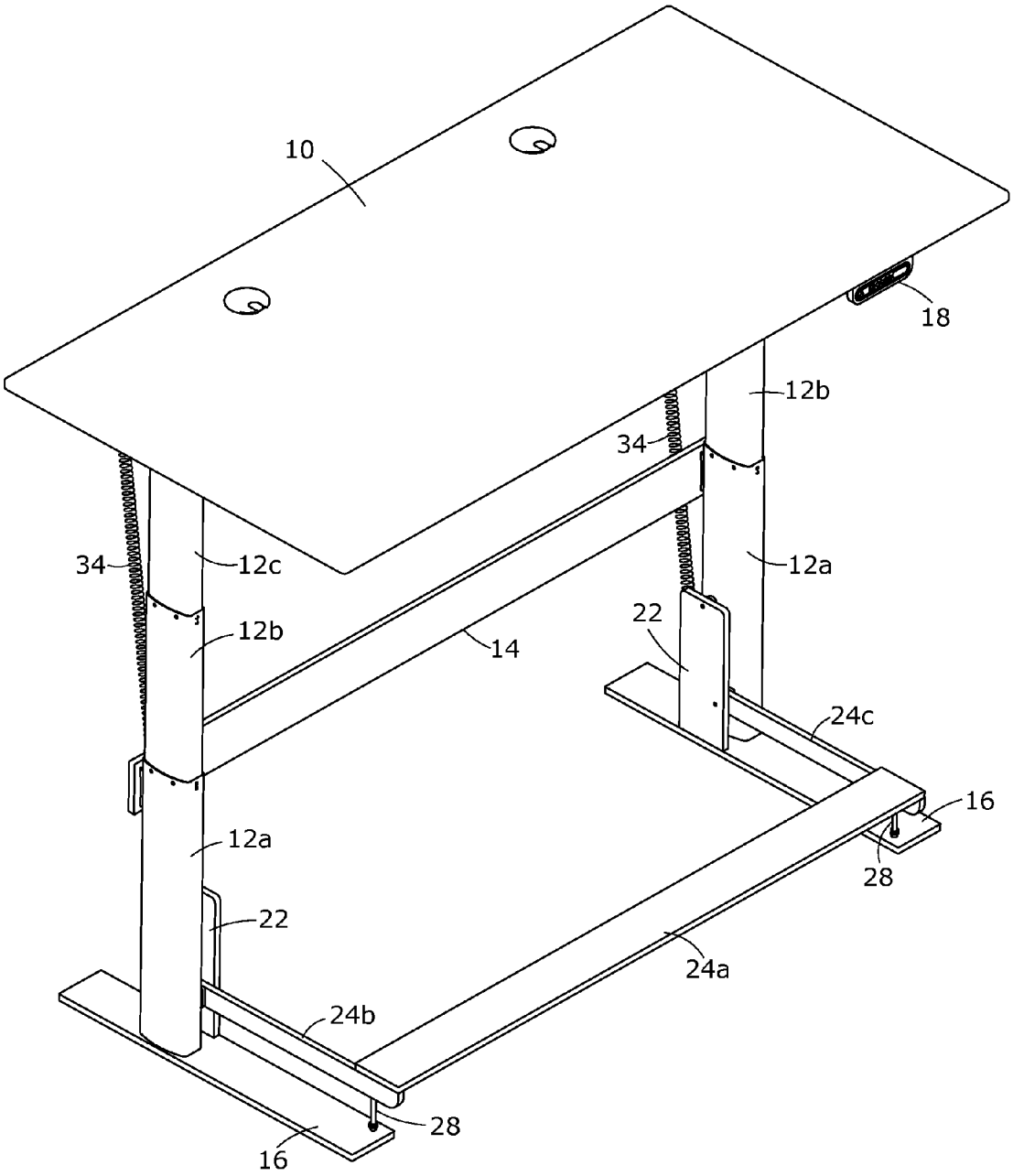
FIG. 2 is a left top perspective view of the desk in a position where the desktop and footrest are in a standing position.

As illustrated in FIGS. 1 and 2, the exemplified desk leg members 12 each comprise three nested, telescopic units 12*a,b,c*, wherein unit 12*b* and 12*c* are exposed when the desk is in a standing position, and are housed within the unit 12*a* when the desk is in a sitting position.

The flat plate base member 16 attached horizontally beneath and to (i.e. to the bottom end of) each desk leg member 12, and it is wide enough to fit the width of a desk leg member 12 and the width of the footrest assembly that resides between the member 12 and the footrest frame member 22 (i.e. the pivot spring connection unit 26).

The optional crossbar member 14 is connected to the bottom unit 12*a* so that is maintains the same position no matter the height of the desktop 10. Crossbar member 14 stabilizes the desk leg members 12 and thus the desktop 10, and it prevents the footrest unit 24 from rotating backwards towards the front of the desk. It also hides the footrest bar from view when it is in the vertical position.

Rotatable Footrest Assembly

The rotatable footrest assembly 20 of the present disclosure may be used with an electric height adjustable desk, such as but not limited to the desk exemplified in FIGS. 1-8; and, it may be used a manual-mechanical, non-powered height adjustable desk. In all embodiments of the present disclosure, the footrest assembly and the desktop move synchronously. In the non-powered desk, the footrest assembly moves in conjunction with the desktop in response to the user activating a mechanism to raise and/or lower the desk, which may or may not require the user exerting a physical force, such as one proportional to the weight of the desktop.

Figure 3:
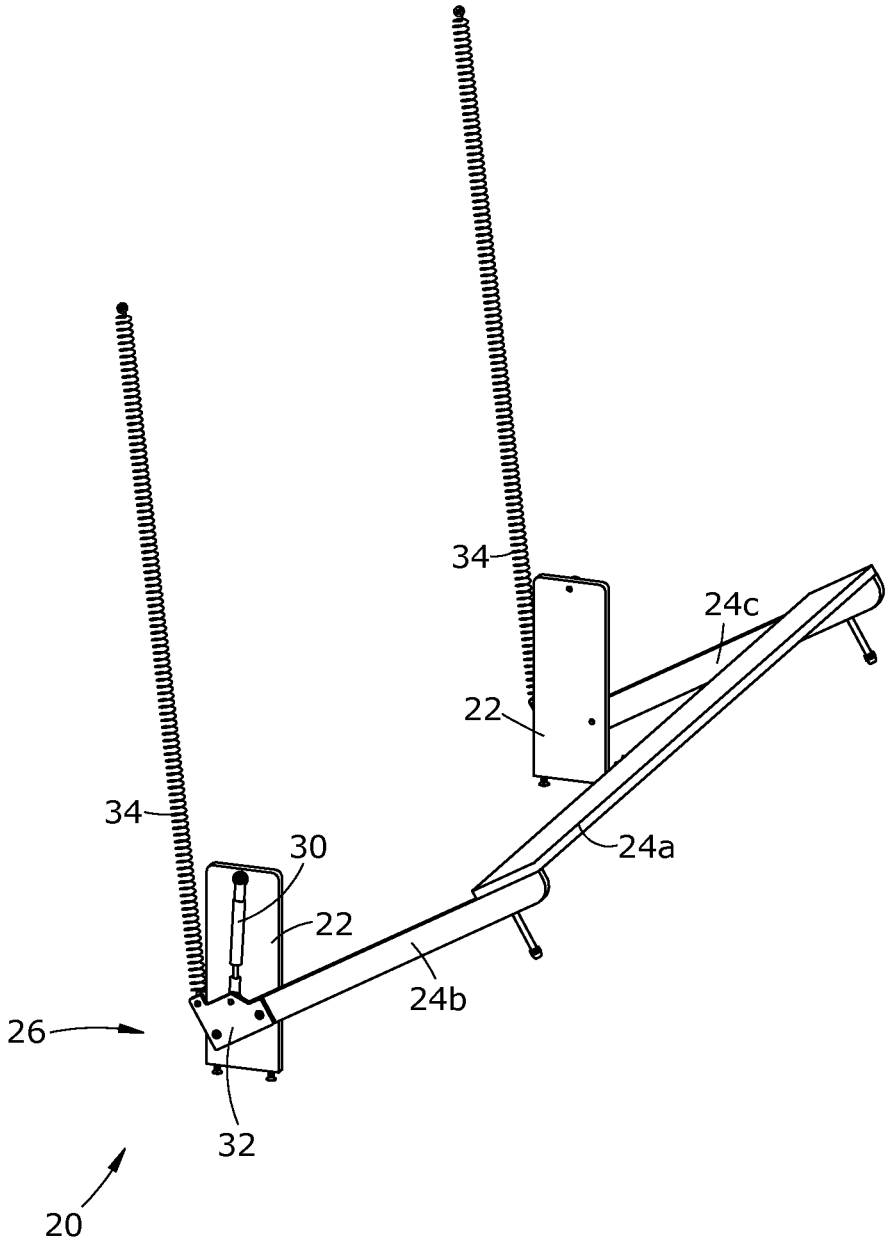
FIG. 3 is a left top perspective view of the footrest assembly comprising the pivot spring connection unit and the rotatable footrest unit.
Figure 4:
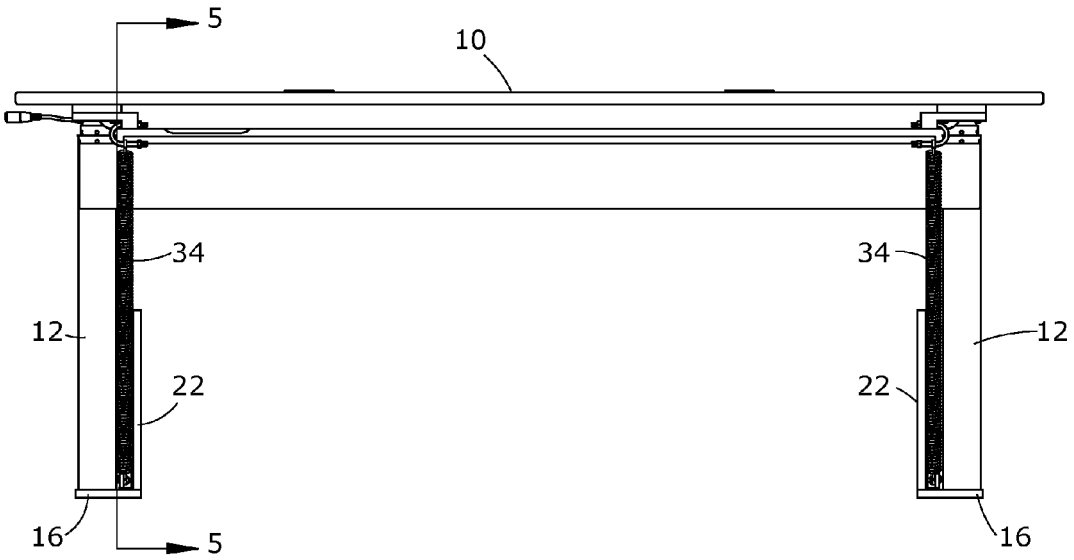
FIG. 4 is an elevated view of the front of the desk with a projection line (5-5) cutting a cross-section between the footrest assembly and the right desk leg member.
Figure 5:
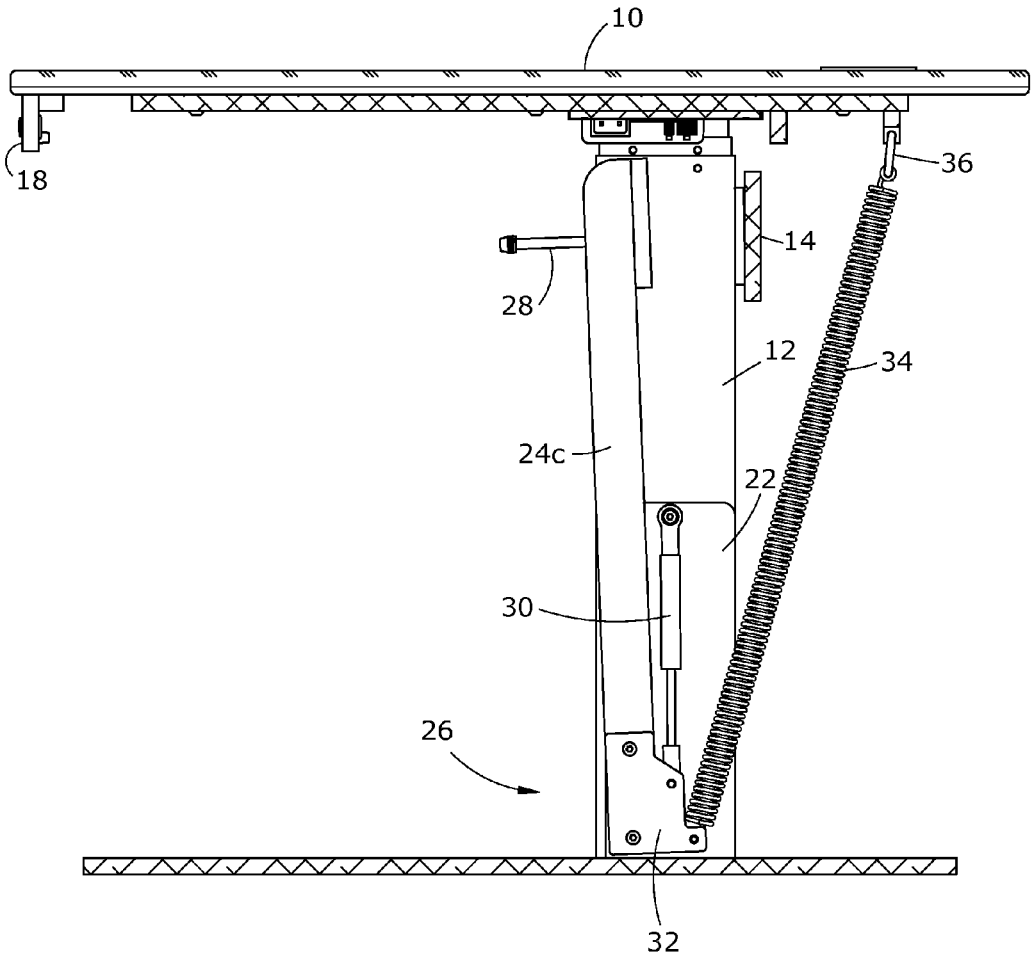
FIG. 5 is a right side view of one embodiment of the desk in a sitting position, the view is along the projection (5-5) of FIG. 3 showing the footrest assembly and the footrest unit comprising: a vertical gas spring connected to a pivot plate, wherein the plate is also connected to a tension spring and a foot bar member.
Figure 6:
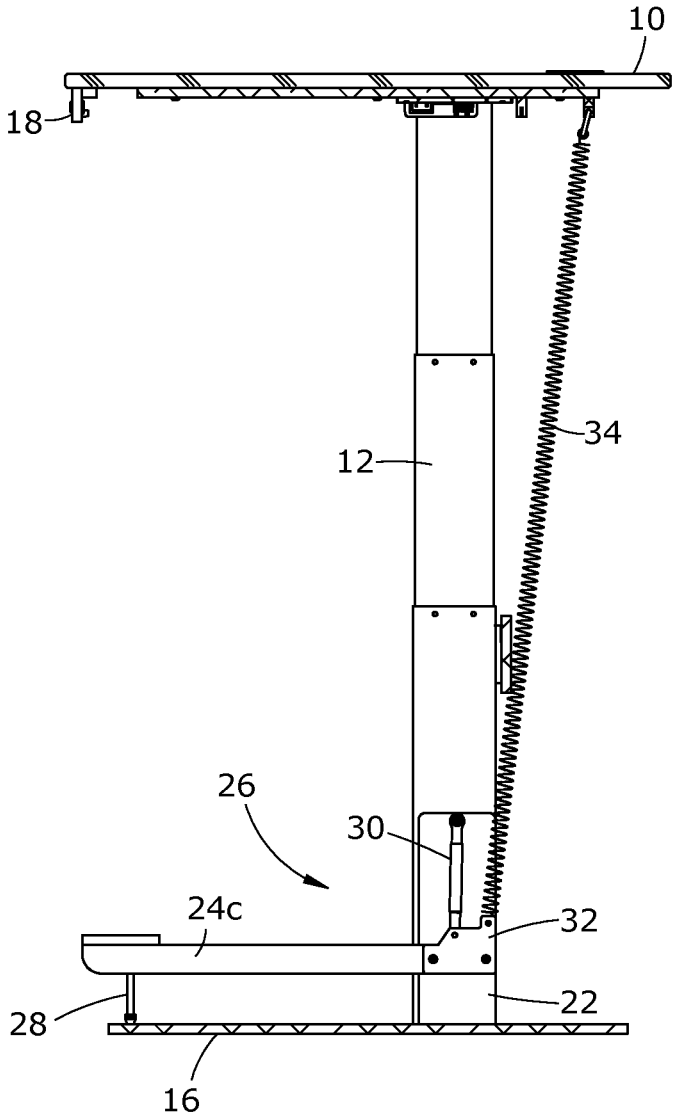
FIG. 6 is a right side view of one embodiment of the desk in a standing position, the view is along the projection (5-5) of FIG. 3 showing the footrest assembly and the footrest unit.
Figure 7:
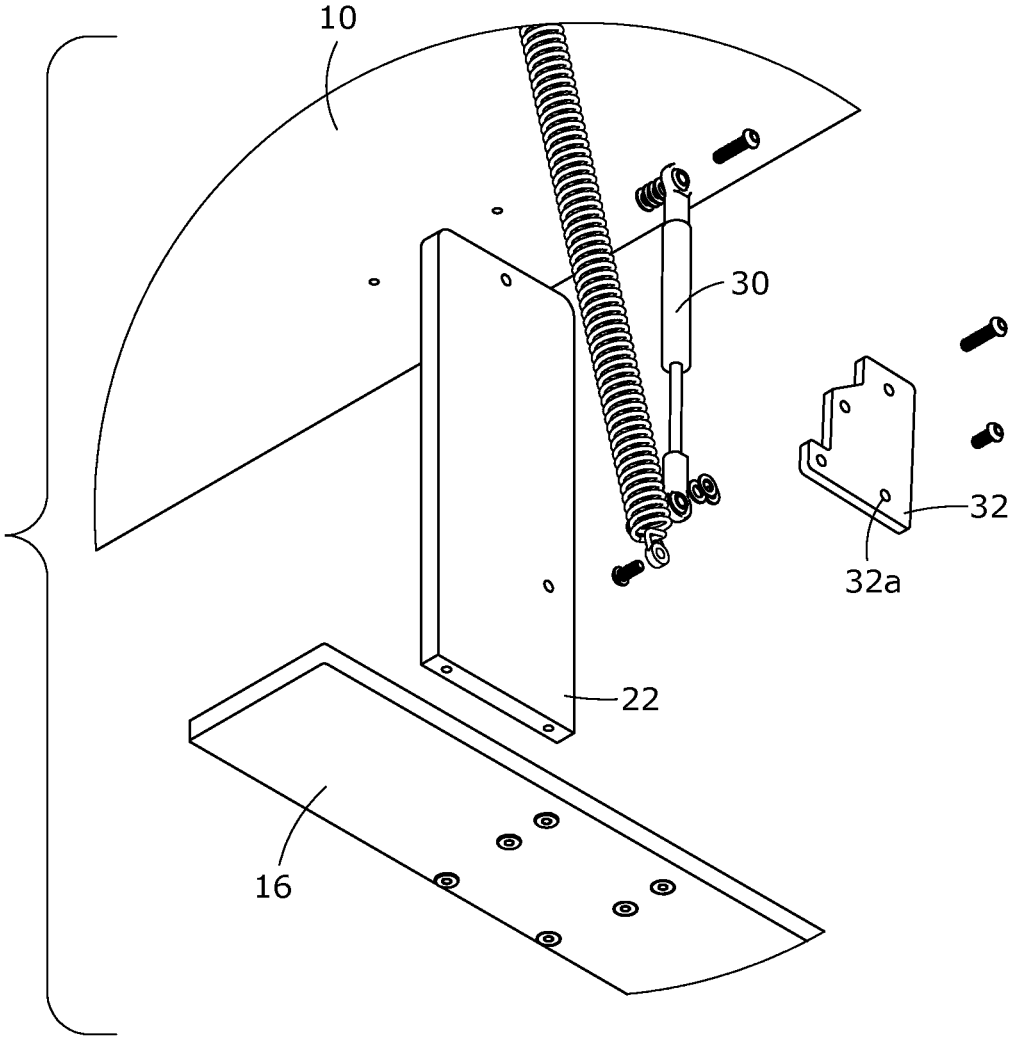
FIG. 7 is an exploded view of the bottom end of the footrest assembly comprising a footrest frame member attached to a flat plate base member and to a pivot spring connection unit
Figure 8:
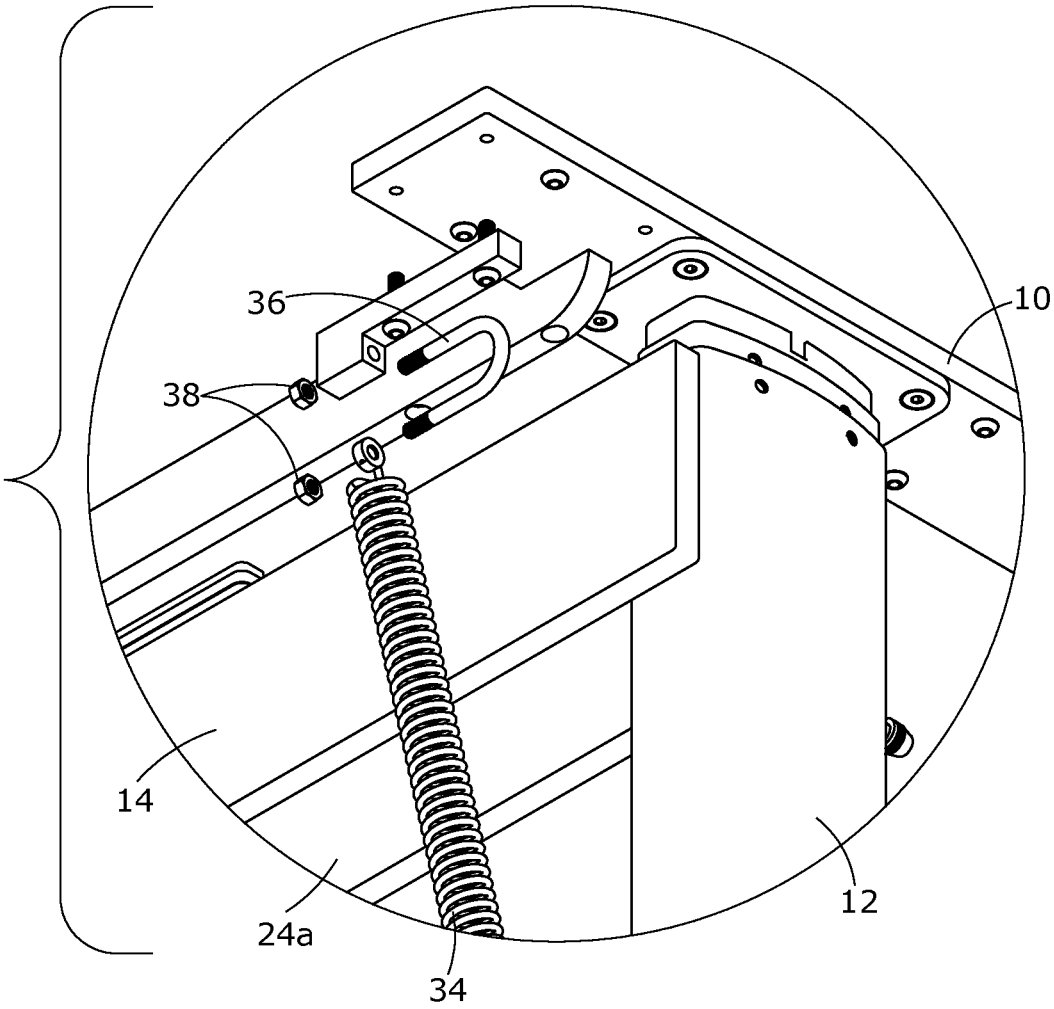
FIG. 8 is an exploded view of top end of the footrest assembly where the underside of the desktop is linked with the tension spring.

The components of the footrest assembly 20 are illustrated in FIG. 3 and comprise: 1) two footrest frame members 22, one each vertically aligned with the bottom end of a desktop leg 12; 2) two pivot spring connection units 26, one each residing between a desktop leg member 12 (not shown) and a footrest frame member 22; and, 3) a rotatable footrest unit 24 comprising a U-shaped foot bar member 24*a,b,c* connected on each end to a pivot spring connection unit 26.

Footrest Frame Members

Each of the two footrest frame members 22 exemplified in the figures is a rectangular flat plates about 8-12 inches in height, with two long sides and two short sides. One short side of each frame member 22 is affixed perpendicularly to a base member 16, such as on the inside edge of the base member 16. Each footrest frame member 22 also lies parallel to a desk leg member 12 near the bottom end of leg member 12. The space between the frame member 22 and the leg member 12 is sufficient to allow the pivot spring connection unit 26 to operate and pivot unimpeded while positioned between member 22 and 12 (i.e. 2-4 inches).

Pivot Spring Connection Unit

In an embodiment, the footrest assembly 20 comprises two pivot spring connection units 26 in which each unit 26 is positioned between a desk leg member 12 and a footrest frame member 22. Each pivot spring connection unit 26 comprises: 1) a gas spring 30; 2) a pivot plate member 32; and, 3) a tension member 34.

Each of the two gas springs 30 is positioned vertically on the footrest frame member 22, and connected on the spring 30 top end to the member 22 and on the spring bottom end to the pivot plate member 32.

The tension member 34 may comprise a tension spring or an elastic band. Each of the two tension members 34 is connected on a top end to the desktop and on the bottom end to the pivot plate member 32. In an embodiment illustrated in FIGS. 5, 6, and the exploded view in FIG. 8, the tension member 34 is fixed at an angle of about 10-30 degrees from the vertical, with the top end of the tension member 34 connected to the underside of the desktop 10 towards the front of the desk. The connection is made using an extension member 36, such as the exemplified U-shaped hook with bolts 38 in FIG. 8. The extension member 36 may be removable or permanently fixed to the desktop; and, the extension member 36 may further comprise additional links or mechanisms to elongate the tension member 34 so as to delay the time and point of elevation of the desktop for when the footrest unit 24 rotates.

The pivot plate member 32 is fixed in parallel to the frame member 22 in a manner that allows it to rotate or pivot about a point fixed on member 22. In an embodiment exemplified in FIG. 7, a screw or a bolt is inserted at point 32*a* on the member 32 to fix it to frame member 22. The pivot plate member 32 is also connected to: 1) the end of the footrest unit 24 (e.g. 24*b,c*); 2) the gas spring 30; and 3) the tension member 34; and, in a position where the angle between the gas spring 30 and the tension member 34 is relatively fixed at about (10-30 degrees) while the angle between the gas spring 30 and the footrest unit 24 ranges from about 10-90 degrees as the footrest unit 24 rotates from a vertical sitting position to a horizontal standing position.

Rotatable Footrest Unit

The rotatable footrest unit 24 comprises a foot bar member connected on each end to a pivot spring connection unit 26 at the pivot plate member 32. In an embodiment not shown, the unit 24 is a curved bar member. In another embodiment illustrated in FIGS. 1-3, 5, and 6, the footrest unit 24 is a straight bar 24*a* for the user to rest a foot upon, and with a left side bar member 24*b* and a right side bar 24*c* fixed perpendicularly to the opposing ends of bar 24*a* to create a substantially U-shaped unit. The opposing ends of the bar 24*b* and 24*c* are affixed to the pivot spring connection unit 26 at the pivot plate member 32.

When the rotatable footrest unit 24*a* is in the sitting position, the unit 24*a* is elevated to about 24-30 inches from the floor, and is therefore not obstructing the user's legs. It is also aligned with the desk crossbar member 14, and thus is it hidden from view by a person standing in front of the desk. And when the rotatable footrest unit 24*a* is in the standing position, the unit 24*a* is only positioned about 3-5 inches from the floor, thus providing proper biomechanical support to the user's spine as they rest one foot upon unit 24*a*.

As illustrated in FIGS. 1, 2, 5, and 6, the footrest unit 24 may also comprise one or more footrest stabilizer members 28 that are connected perpendicular to the unit 24, such as at the corners of the "U" shape bar. Stabilizer members 28 maintain the unit 24 parallel to and off of the ground when the desktop is lowered and in a standing position. In the exemplified embodiment illustrated in the figures, the unit 24 comprises three perpendicular bar members 24 *a,b,c*, and one stabilizer member 28 (two total per desk) is located at the junction between 24*a* and 24*b*, and at the junction between 24*a* and 24*c*. The members 28 may further comprise a rubber stopper on the bottom end of each member 28. The members 28 can also stand upon the desk's flat plate base members 16, versus a soft carpet. In addition to providing a solid, stable surface for the user to rest a foot upon, the stabilizer members 28 prevent the footrest assembly from bending and being damaged.

Mechanism of Footrest Assembly Rotation

Disclosed herein is a discussion on the mechanical means by which the footrest unit 24 rotates in conjunction with the vertical movement of the desktop 10. It is noted that this disclosure is not to be limited by any specific technical explanation of force generation; and, one skilled in the art could readily modify the types of springs and tension members to produce the same result.

Forces exerted by the gas spring 30 and the tension member 34 (e.g. tension or torsion or helical spring or elastic band) are balanced to cause the footrest unit 24 to rotate smoothly between a vertical position and a horizontal position as the desktop 10 is raised and lowered. When the desktop is lowered for a sitting position, the tension member 34 is unexpanded without generating a force on the rotating footrest unit 24. Concurrently, the gas spring 30 is fully expanded, and thus holding the footrest unit 24 in a vertical, upright position.

The tension member 34 is stretched when the desktop 10 starts to rise in response to the user activating the power switch 18 to expand the desk leg members 12. This stretching of the tension member 34 produces a small tension, pulling or recoil force on the pivot plate member 32 that is less than the vertical downward force exerted by the gas spring 30 during the first inches that the desktop 10 rises. The longer the tension member 34 is stretched as the desktop 10 rises, the larger the recoil force in the tension member 34. Eventually the recoil force of the tension member 34 will exceed the gas spring compressive force, causing the gas spring 30 to collapse, and retract upward as the footrest unit 24 rotates downward to a horizontal position.

While the footrest unit 24 is in a fully horizontal position and the desktop 10 is in a standing position, the gas spring 30 continues to be compressed and the tension member 34 is fully extended and stretched, which produces a recoil energy that is stored in the tension member 34. Then when the user activates the power switch 18 to lower the desk leg members 12, the tension member 34 is relaxed and the energy that was stored in the tension member 34 is released as a pushing force on the pivot-table member 32 which causes the footrest unit 24 to rotate upward. As the footrest unit 24 rotates from the horizontal position to a vertical position, the plate member 32 pivots while the gas spring 30 expands.

When the footrest unit 24 returns to the vertical position and the desktop 10 is in a sitting position, the gas spring 30 again exerts a compression force vertically downward on the pivot plate member 32. Likewise, the tension member 34 is fully retracted.

Although the present disclosure has been described with reference to one or more embodiments, workers skilled in the art will recognize that changes may be made in form and detail without departing from the scope of the disclosure and/or the appended claims.

Information as herein shown and described in detail is fully capable of attaining the above-described object of the disclosure and is, thus, representative of the subject matter which is broadly contemplated by the present disclosure. The scope of the present disclosure fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described embodiments and additional embodiments that are known to those of ordinary skill in the art are hereby expressly incorporated by reference and are intended to be encompassed by the present claims.

What is claimed is:

1. An automated height adjustable desk with a synchronous moving footrest assembly, comprising:

a) a horizontal desktop adjustable between a sitting and a standing position;

b) two or more vertical height adjustable desk leg members supporting the desktop;

c) two or more flat plate base members, each attached horizontally beneath and to a desk leg member;

d) a footrest assembly comprising, i) two footrest frame members, each member vertically aligned with one height adjustable desk leg member, and connected to a rotatable footrest unit;

ii) a rotatable footrest unit comprising a foot bar member with two opposing ends, each end connected to a pivot spring connection unit; and iii) two pivot spring connection units, each of said two pivot spring connection units being respectively positioned between the footrest frame member and the desk leg member, wherein each of said two pivot spring connection units are configured to rotate the footrest unit between a vertical position when the desktop is in a sitting position and a horizontal position when the desktop is in a standing position.

2. The automated height adjustable desk of claim 1, wherein the desk leg members are vertically moveable under the control of an electric actuator.

3. The automated height adjustable desk of claim 1, wherein the rotatable footrest unit further comprises a right and a left straight side bar member affixed perpendicularly to the opposing ends of a straight foot bar member.

4. The automated height adjustable desk of claim 1, wherein the footrest unit further comprises two or more footrest stabilizer members connected perpendicularly downward from footrest unit and resting on a horizontal base member, and able to maintain the footrest unit parallel to and off the ground when the desktop is in a standing position.

5. The automated height adjustable desk of claim 1, further comprising a horizontal crossbar member connecting two desk leg members and able to prevent the foot bar member from overrotating.

6. The automated height adjustable desk of claim 1, wherein the pivot spring connection unit further comprises a mechanism to simultaneously rotate the footrest when the desktop is raised and lowered, comprising:

a) a gas spring, each gas spring connected vertically on a top end to the footrest frame member and on the bottom end to a pivot plate member;

b) a pivot plate member affixed in parallel to and rotatable on the footrest frame member;

c) a tension member connected on a top end to the desktop and on a bottom end to the pivot plate member.

7. The automated height adjustable desk of claim 6, wherein the tension member comprises a tension spring or an elastic band.

8. The automated height adjustable desk of claim 6, wherein the gas spring and the tension member are configured to pivot the footrest unit to a vertical position when the desktop is lowered.

9. The automated height adjustable desk of claim 6, wherein the tension member further comprises an extension member connected between the top end of the tension member and the desktop and able to delay pivoting the footrest unit until the desktop has reached a selected height.

10. A rotatable footrest assembly attached to a height adjustable desk, comprising:

a) two footrest frame members, each member vertically aligned with a height adjustable desk leg member, and connected to a rotatable footrest unit;

b) a rotatable footrest unit comprising a foot bar member with two ends, each end connected to a pivot spring connection unit; and c) two pivot spring connection units, each of said two pivot spring connection units being respectively positioned between the footrest frame member and the desk leg member, wherein each of said two pivot spring connection units are configured to rotate the footrest unit between a vertical position when a desktop is in a sitting position and a horizontal position when the desktop is in a standing position d) wherein the pivot spring connection unit further comprises a mechanism to simultaneously rotate the footrest between a vertical and horizontal position when the desktop is lowered and raised, comprising i) a gas spring vertically positioned and connected on a top end to the footrest frame member and on the bottom end to a pivot plate member;

ii) a pivot plate member affixed in parallel to and rotatable on a footrest frame members; and, iii) a tension member, connected on a top end to the desktop and on a bottom end to the pivot plate member.

11. The rotatable footrest assembly of claim 10, wherein the tension member comprises a tension spring or an elastic band.

12. The rotatable footrest assembly of claim 10, wherein the rotatable footrest unit further comprises two or more footrest stabilizer members configured perpendicular to the footrest unit and able to maintain the footrest unit parallel to and off of the ground when the desktop is in a standing position, wherein a bottom end of the stabilizer member rests upon a flat plate base member attached horizontally beneath and to a desk leg member.

13. The rotatable footrest assembly of claim 10, wherein the tension member further comprises an extension member connected between the top end of the tension member and the desktop and able to delay pivoting the footrest unit from a vertical to a horizontal position until the desktop has reached a selected height.

14. A method of simultaneously rotating a footrest between a vertical and a horizontal position beneath a height adjustable desk while vertically moving a desktop of the desk up and down, comprising the steps of:

a) providing a height adjustable desk comprising, i) a desktop adjustable between a sitting and a standing position;

ii) two or more height adjustable desk leg members supporting the desktop;

iii) a flat plate base member attached horizontally beneath and to each height adjustable desk leg member;

iv) a footrest assembly comprising, two footrest frame members, one each vertically aligned with a height adjustable desk leg member, and connected to a rotatable footrest;

a rotatable footrest unit comprising a foot bar member with two ends, each end connected to a pivot spring connection unit;

two pivot spring connection units, each of said pivot spring connection units being respectively positioned between the footrest frame member and the desk leg member, wherein each of said two pivot spring connection units are configured to rotate the footrest unit between a vertical position when the desktop is in a sitting position and a horizontal position when the desktop is in a standing position;

b) raising the desktop under the operational control of an electric actuator, and simultaneously lowering the footrest to a horizontal position; and, c) lowering the desktop under the operational control of the electric actuator, and simultaneously raising the footrest to a vertical position.

15. The method of claim 14, wherein the pivot spring connection unit further comprises a mechanism to simultaneously rotate the footrest when the desktop is raised and lowered, comprising:

i) a gas spring, each gas spring connected vertically on a top end to the footrest frame member and on the bottom end to a pivot plate member;

ii) a pivot plate member affixed in parallel to and rotatable on the footrest frame member; and, iii) a tension member connected on a top end to the desktop and on a bottom end to the pivot plate member.

16. The method of claim 15, wherein raising and lowering the desktop comprises the tension members and the gas springs generating forces to simultaneously pivot the footrest unit between a vertical and a horizontal position.

17. The method of claim 15, wherein the tension member comprises a tension spring or an elastic band.

18. The method of claim 14, wherein the desk further comprises a horizontal crossbar member connecting two desk leg members and able to prevent the foot bar member from over-rotating.

* * * * *